US009247329B2

(12) United States Patent
Sondergaard

(10) Patent No.: US 9,247,329 B2
(45) Date of Patent: Jan. 26, 2016

(54) SUSPENSION FOR A HEARING DEVICE RECEIVER

(71) Applicant: GN ReSound A/S, Ballerup (DK)

(72) Inventor: Morten Birkmose Sondergaard, Hillerod (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 14/056,807

(22) Filed: Oct. 17, 2013

(65) Prior Publication Data

US 2015/0110328 A1 Apr. 23, 2015

(30) Foreign Application Priority Data

Oct. 17, 2013 (DK) ..... 2013 70593
Oct. 17, 2013 (EP) ..... 13189046

(51) Int. Cl.
*H04R 25/00* (2006.01)
*H04R 1/02* (2006.01)
*H04R 1/10* (2006.01)

(52) U.S. Cl.
CPC ..... *H04R 1/02* (2013.01); *H04R 25/456* (2013.01); *H04R 25/604* (2013.01); *H04R 1/1016* (2013.01); *H04R 2225/021* (2013.01)

(58) Field of Classification Search
USPC ..... 381/330, 382
See application file for complete search history.

(56) References Cited

U.S. PATENT DOCUMENTS 5,902,023 A 5/1999 Yu et al.
6,482,144 B1 11/2002 Mueller
7,324,653 B2 * 1/2008 Mehr ..... 381/324
8,693,718 B2 * 4/2014 Agustiar et al. ..... 381/322
8,737,657 B2 * 5/2014 Sondergaard et al. ..... 381/322
2003/0185412 A1 10/2003 Gebert et al.
2005/0082447 A1 4/2005 Chuang (Continued)

FOREIGN PATENT DOCUMENTS

WO 2004/008803 A1 1/2004
WO WO 2004/008803 1/2004

(Continued)

OTHER PUBLICATIONS

European Search Report for EP Patent Application No. 13189046.9 dated Mar. 18, 2014.

(Continued)

*Primary Examiner* — Davetta W Goins
*Assistant Examiner* — Amir Etesam
(74) *Attorney, Agent, or Firm* — Vista IP Law Group, LLP

(57) ABSTRACT

A suspension for a hearing device receiver includes: a receiver holding part; and a damping structure with a body and a receiver base, the body comprising a first body part, the damping structure having an inner surface forming a sound duct, the sound duct extending through the first body part, the damping structure having a first opening at a first sound duct end, the first opening configured for connecting an output port of a receiver, the damping structure having a second opening at a second sound duct end, the sound duct providing a sound path for conveying sound energy from the receiver through the damping structure to the second opening, the first body part extending from the receiver base; wherein the damping structure comprises a first damping element connecting the body and the receiver base so that the receiver base is separate from and in parallel to the first body part.

16 Claims, 8 Drawing Sheets

(56) References Cited

U.S. PATENT DOCUMENTS

| | | | | |
|---|---|---|---|---|
| 2006/0239488 | A1 | 10/2006 | Geschiere et al. | |
| 2008/0002848 | A1* | 1/2008 | Heerlein et al. | 381/328 |
| 2008/0317269 | A1 | 12/2008 | Tipsmark et al. | |
| 2008/0317272 | A1* | 12/2008 | Ho | H04R 25/456 381/330 |
| 2009/0161897 | A1 | 6/2009 | Fickweiler et al. | |
| 2010/0098286 | A1 | 4/2010 | Giese et al. | |
| 2011/0013796 | A1 | 1/2011 | Agustiar et al. | |

FOREIGN PATENT DOCUMENTS

| | | | |
|---|---|---|---|
| WO | WO 2004/100608 | | 11/2004 |
| WO | 2007/011421 | A1 | 1/2007 |
| WO | WO 2007/011421 | | 1/2007 |
| WO | 2012/062761 | A1 | 5/2012 |
| WO | WO 2012/062761 | | 5/2012 |

OTHER PUBLICATIONS

First Technical Examination for Dutch Patent Application No. P81302264DK00, dated Apr. 28, 2014.

Extended European Search Report dated Jul. 1, 2014, for related EP Patent Application No. 131890469.9, 14 pages.

International Search Report and Written Opinion dated Apr. 13, 2015 for related PCT Patent Application No. PCT/EP2014/072151, 16 pages.

* cited by examiner

SUSPENSION FOR A HEARING DEVICE RECEIVER

RELATED APPLICATION DATA

This U.S. patent application claims priority to and the benefit of Danish Patent Application No. PA 2013 70593, filed on Oct. 17, 2013, pending, and European Patent Application No. 13189046.9, filed on Oct. 17, 2013, pending. The entire disclosures of both of the above applications are expressly incorporated by reference herein.

FIELD

The present specification relates to a suspension for a hearing device receiver and to a method for producing a hearing device with such a suspension. Additionally, the present specification relates to a hearing device comprising such a suspension.

BACKGROUND

A hearing device comprises a microphone which receives acoustic signals. The received acoustic signals are processed where the processing may include amplification of the acoustic signals. The signal processing may preferably be digital. The processed signals are transmitted to a receiver of the hearing device which converts the processed signals into an acoustic output signal e.g. with a larger amplitude at certain frequencies. The receiver broadcasts the acoustic output signal towards the tympanic membrane of a user of the hearing device.

The broadcasting of the acoustic output signal can cause the receiver and the hearing device to vibrate which vibrations may be transmitted back to the microphone resulting in an unwanted feedback loop thereby putting a limitation on the amplification which the hearing device may deliver to the user.

Suspensions for hearing device receivers are known in the art, see for example international patent applications published under WO 2004/008803, WO 2007/011421 and WO 2012/062761.

SUMMARY

Accordingly, there is a need to reduce the transmission of vibrations generated by the receiver to the rest of the hearing device and it is an object to provide a suspension for a hearing device receiver with an improved reduction of vibrations.

The above-mentioned and other objects are fulfilled by a suspension for a receiver in a hearing device, the suspension comprising a receiver holding part, and a damping structure with a body and a receiver base, the body comprising a first body part. The damping structure has an inner surface forming a sound duct in the damping structure, the sound duct extending through the first body part, the damping structure having a first opening at a first sound duct end. The first opening may be configured for connecting an output port of the receiver to the sound duct. The damping structure has a second opening at a second sound duct end, the sound duct providing a sound path for conveying sound energy from the receiver through the damping structure to the second opening, the first body part extending from the receiver base. The damping structure comprises at least a first damping element. The first damping element may connect the body and the receiver base separate from and/or in parallel to the first body part.

Also disclosed is a hearing device comprising a hearing device receiver, a hearing device structural frame and a suspension as described herein, wherein the hearing device receiver is mounted in the suspension. An output port of the receiver may be positioned in a first opening of the sound duct of the hearing device damping structure.

It is an advantage that a suspension for a hearing device receiver is obtained that reduce the transmission of vibrations generated by the receiver to the rest of the hearing device, and thus to the microphone of the hearing device.

A suspension for a receiver in a hearing device, includes: a receiver holding part; and a damping structure with a body and a receiver base, the body comprising a first body part, the damping structure having an inner surface forming a sound duct in the damping structure, the sound duct extending through the first body part, the damping structure having a first opening at a first sound duct end, the first opening configured for connecting an output port of a receiver to the sound duct, the damping structure having a second opening at a second sound duct end, the sound duct providing a sound path for conveying sound energy from the receiver through the damping structure to the second opening, the first body part extending from the receiver base; wherein the damping structure comprises at least a first damping element connecting the body and the receiver base so that the receiver base is separate from and in parallel to the first body part of the body.

Optionally, the body comprises a second body part positioned between the second sound duct end and the first body part, the sound duct extending through the second body part, the second body part having a corrugated outer surface.

Optionally, the first damping element extends from the receiver base to the body forming a gap between the first damping element and the first body part.

Optionally, the first body part comprises a second damping element extending from the receiver base.

Optionally, a first longitudinal axis of a first sound duct part in the first body part, and a second longitudinal axis of a second sound duct part in the second body part form an angle that is anywhere from 15° to 45°.

Optionally, the first damping element, in a first cross section that is perpendicular to the first longitudinal axis, covers an area of less than 10% of a receiver base area.

Optionally, the body comprises a third body part between the first body part and the second body part for absorbing a part of vibrational energy from the receiver.

Optionally, a first outer surface of the first body part in a cross section perpendicular to the sound duct is non-circular.

Optionally, the receiver holding part forms a receiver compartment and comprises a first portion connected to the receiver base, and a second portion, wherein the first portion and the second portion are connected by a plurality of bridging elements.

Optionally, the second portion comprises an insertion opening for insertion of a hearing aid receiver in the receiver compartment.

Optionally, the second portion of the receiver holding part comprises a plurality of cushioning zones for absorbtion of mechanical shock.

Optionally, the damping structure comprises a mounting element at the second opening for mounting the suspension to a structural frame of the hearing device.

A hearing device includes: a receiver; a hearing device structural frame; and a suspension, wherein the receiver is mounted in the suspension; wherein the suspension comprises: a receiver holding part; and a damping structure with a body and a receiver base, the body comprising a first body part, the damping structure having an inner surface forming a sound duct in the damping structure, the sound duct extending through the first body part, the damping structure having a first opening at a first sound duct end, the first opening configured for connecting an output port of the receiver to the sound duct, the damping structure having a second opening at a second sound duct end, the sound duct providing a sound path for conveying sound energy from the receiver through the damping structure to the second opening, the first body part extending from the receiver base; wherein the damping structure comprises at least a first damping element connecting the body and the receiver base so that the receiver base is separate from and in parallel to the first body part of the body.

Optionally, the output port of the receiver is positioned in the first opening of the sound duct.

Other and further aspects and features will be evident from reading the following detailed description.

BRIEF DESCRIPTION OF THE DRAWINGS

The drawings illustrate the design and utility of various features described herein, in which similar elements are referred to by common reference numerals. In order to better appreciate how the above-recited and other advantages and objects are obtained, a more particular description will be rendered, which are illustrated in the accompanying drawings. These drawings depict only exemplary features and are not therefore to be considered limiting in the scope of the claims.

The above and other features and advantages will become readily apparent to those skilled in the art by the following detailed description of exemplary embodiments thereof with reference to the attached drawings, in which.

DETAILED DESCRIPTION

Figure 1:
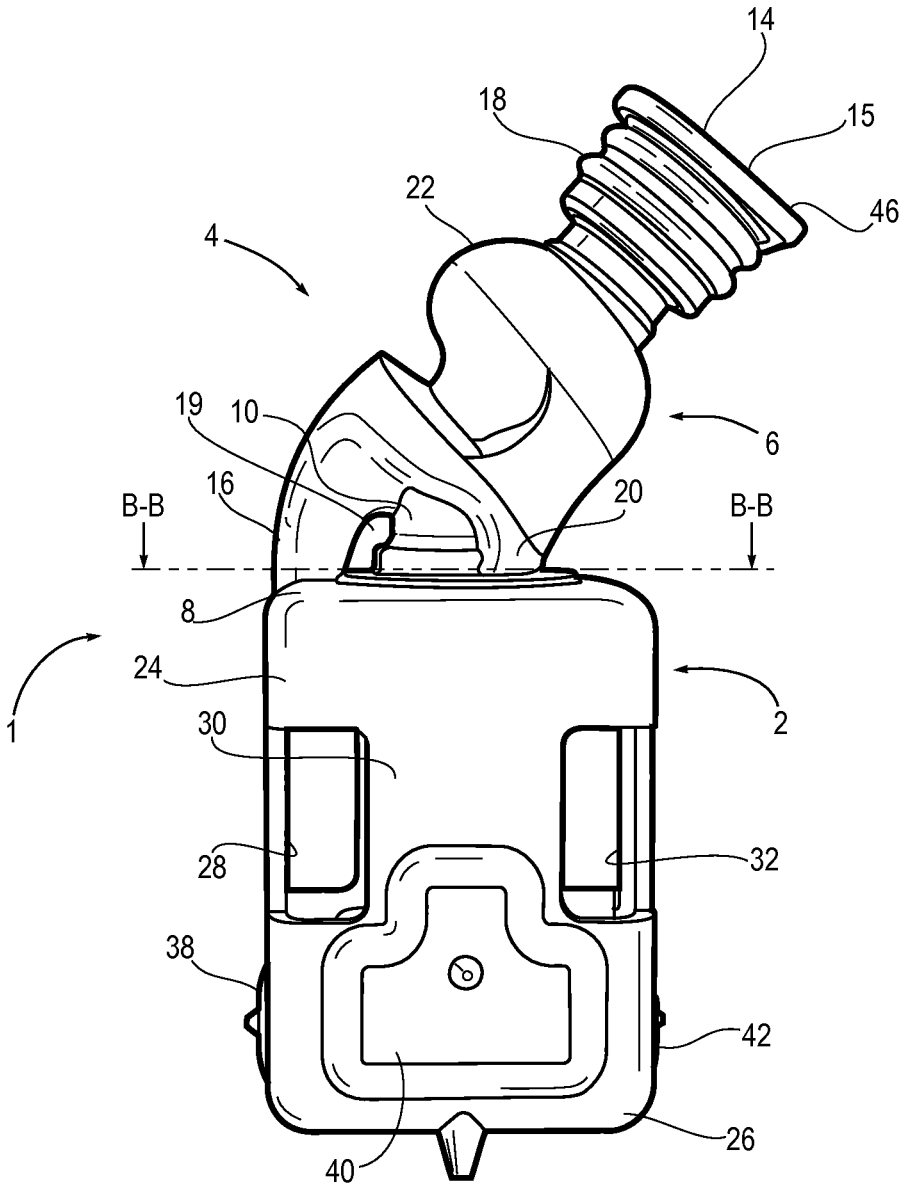
FIG. 1 is a schematic first side view of an exemplary suspension according to some embodiments.

Various features are described hereinafter with reference to the figures. It should be noted that the figures are not drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated.

A suspension with improved damping capabilities for damping vibrations from a hearing device receiver is provided.

The suspension comprises a receiver holding part for holding or accommodating a receiver. The receiver may be attached to or mounted in the receiver holding part by gluing and/or a mechanical pressfit.

The suspension comprises a damping structure for damping or attenuating vibrations transferred from the receiver to other parts of a hearing instrument, such as a structural frame of a hearing instrument.

The suspension has a body and a receiver base. The body has a first body end and a second body end and comprises a first body part and optionally a second body part. The body may comprise a third body part, e.g. between the first body part and the second body part for absorbing a part of the vibrational energy from the receiver.

The damping structure has an inner surface forming a sound duct in the damping structure. The sound duct extends through the first body part. The damping structure has a first opening at a first sound duct end, wherein the first opening is configured for connecting an output port of the receiver to the sound duct. Further, the damping structure has a second opening at a second sound duct end and the sound duct providing a sound path for conveying sound energy from the receiver through the damping structure to the second opening. The sound duct extends along a sound duct axis, and the sound duct axis may be straight or curved. The sound duct may extend through the second body part and/or through a third body part. The first opening may be centered or substantially centered in the receiver base.

The sound duct may have a first sound duct part in the first body part. The sound duct may have a second sound duct part in the second body part. A first longitudinal axis of the first sound duct part in the first body part and a second longitudinal axis of a second sound duct part in the second body part form an angle, such as in the range from 5° to 75°. The angle between the first longitudinal axis and the second longitudinal axis may be in the range from 10° to 60°, such as from 15° to 45°

The first body part extends from the receiver base and has a first outer surface.

The receiver base may have a rectangular or squared cross-section perpendicular to the first longitudinal, e.g. with rounded corners. The sound duct may be centered in the receiver base.

The second body part has a second outer surface. The second body part may be positioned between the second sound duct end and the first body part, the sound duct extending through the second body part. The second outer surface may be a corrugated second outer surface.

The damping structure comprises one or more damping elements including a first damping element. The first damping element has a first damping surface. The first damping element connects the body and the receiver base separate from and in parallel to the first body part. The first damping element may extend from the receiver base to the body forming a gap between the first damping element and the first body part.

It may be desired to reduce the thickness of one or more damping elements, such as the first damping element in order to reduce transfer of vibrations from the receiver base to the body through the damping element. The first damping element may in a first cross section perpendicular to the first longitudinal axis cover or span an area of less than 10% of a receiver base area. The receiver base area may be defined as the maximum area spanned by the receiver base perpendicular to the first longitudinal axis.

The first damping element may in one or more cross-sections including a first cross section perpendicular to the first longitudinal axis cover or span an area in the range from 0.5 $mm^2$ to 10 $mm^2$. The first damping element in the first cross section may have an area of at least 1 $mm^2$. The gap between the first damping element and the first body part may in one or more cross-sections perpendicular to the first longitudinal axis, e.g. the first cross-section be larger than 0.2 mm. The gap between the first damping element and the first body part may in the first cross-section be in the range from 0.3 mm to 10 mm, such as in the range from 1 mm to 5 mm.

The first damping element may extend or at least partly extend from a corner section of the receiver base. A corner section of the receiver base is an area defined by points in a cross section of the receiver base perpendicular to the first longitudinal axis, the points being within a corner distance from the corner. The corner distance may be 4 mm or less than 4 mm, such as 3 mm or less than 3 mm. In an exemplary suspension, the corner distance may be 2 mm or less than 2 mm.

The first damping element may extend or at least partly extend from an edge section of the receiver base. An edge section of the receiver base is an area defined by points in a cross section of the receiver base perpendicular to the first longitudinal axis, the points being within an edge distance from the receiver base edge. The edge distance may be 4 mm or less than 4 mm, such as 3 mm or less than 3 mm. In an exemplary suspension, the edge distance may be 2 mm or less than 2 mm.

One or more damping elements extending or at least partly extending from corner and/or edge sections of the receiver base provide improved damping capabilities of the suspension.

The damping structure may comprise a second damping element having a second damping surface. The second damping element may be comprised or integrated in the first body part, i.e. the first body part may comprise a second damping element. The second damping element may be formed as protrusions, bulges, recesses or a combination thereof in the first outer surface of the first body part, resulting in a non-cylindrical first body part.

In one or more exemplary suspensions, the second damping element may connect the body and the receiver base separate from and in parallel to the first body part. The second damping element may extend from the receiver base to the body forming a gap between the second damping element and the first body part.

Thus, the first body part, e.g. comprising the second damping element, may have an irregular or non-circular first outer surface in one or more cross-sections perpendicular to the first longitudinal axis or the sound duct axis. The second damping element may extend from the receiver base. The first outer surface of the first body part may in one or more cross-sections perpendicular to the sound duct be non-circular, such as oval, egg-shaped, or irregular.

In one or more cross-sections perpendicular to the sound duct, the first outer surface of the first body part may comprise a first concave section and/or a second concave section.

The first body part may in the first cross section span an area of at least 1 $mm^2$. A first distance from a first point on the first outer surface to the inner surface in the first cross section may be less than 2 mm. A second distance from a second point on the first outer surface to the inner surface in the first cross section may be larger than 2 mm such as in the range from 3 mm to 20 mm.

The second damping element may extend or at least partly extend from a corner section of the receiver base. The second damping element may extend from a corner section of the receiver base different from and/or diagonal to the corner section from which the first damping element extends, i.e. the first damping element may extend or at least partly extend from a first corner section and the second damping element may extend or at least partly extend from a second corner section.

The second damping element may extend or at least partly extend from an edge section of the receiver base.

The receiver holding part may form a receiver compartment. The receiver holding part may comprise a first portion connected to the receiver base part, and a second portion. The first portion and the second portion may be connected by one or a plurality of bridging elements. The second portion may comprise an insertion opening for insertion of a hearing aid receiver in the receiver compartment. The first portion and/or the second portion of the receiver holding part may each comprise one or a plurality of cushioning zones for absorption of mechanical shock.

The damping structure may comprise a mounting element, e.g. at the second opening for mounting the suspension to a structural frame of a hearing device. The mounting element may be a flange or one or more protrusions extending radially from the second longitudinal axis. The mounting element may comprise an inner and/or outer threading at the second body end.

FIG. 1 is a schematic first side view of an exemplary suspension 1. The suspension comprises a receiver holding part 2 and a damping structure 4. The damping structure 4 has a body 6 and a receiver base 8. The body 6 comprises a first body part 10 extending from the receiver base 8. The damping structure 4 has an inner surface forming a sound duct 11 (see FIG. 6) in the damping structure 4 extending through the first body part 10. The damping structure 4 has a first opening 12 (see FIGS. 6 and 8) at a first sound duct end 13, wherein the first opening 12 is configured for connecting an output port of a receiver to the sound duct 11. During assembly, the receiver is positioned inside the receiver holding part 2. The damping structure 4 has a second opening 14 (see FIG. 6) at a second sound duct end 15. Thus, the sound duct provides a sound path for conveying sound energy from the receiver, positioned inside or otherwise mounted to the receiver holding part 2, through the damping structure to the second opening 14. The sound duct 11 of the suspension 1 has a constant circular cross section from the first opening 12 to the second opening 14. The sound duct radius depends on the receiver type and is in illustrated suspension 1 in the range from 0.75 mm to 1.5 mm.

The damping structure 4 comprises a first damping element 16 connecting the body 6 and the receiver base 8 separate from and in parallel to the first body part 10.

The body 6 comprises a second body part 18 positioned between the second sound duct end 15 and the first body part 10. The sound duct 11 extends through the second body part 18 and the second body part 18 has a corrugated second outer surface.

The first damping element 16 extends from the receiver base 8 to the body 6 in parallel to the first body part 10 forming a gap 19 between the first damping element 16 and the first body part 10, the gap 19 having a maximum gap or gap opening larger than 1 mm. Separating the first damping element 16 from the first body part 10 provides improved damping of one or more selected frequencies or frequency ranges.

In the suspension 1 illustrated in FIG. 1, the first body part 10 comprises a second damping element 20 extending from the receiver base 8. In the suspension 1, the second damping element 20 is integrated in the first body part 10 and a first outer surface of the first body part in a cross section perpendicular to the sound duct is non-circular.

The body 6 comprises a third body part 22 between the first body part 10 and the second body part 18. The third body part 22 is absorbing a part of the vibrational energy from the receiver positioned inside the receiver holding part 2.

In the suspension illustrated in FIG. 1, the receiver holding part 2 forms a receiver compartment and comprises a first portion 24 connected to the receiver base part 8, and a second portion 26. The first portion 24 and the second portion 26 are connected by a plurality of bridge elements 28, 30, 32, 34.

The second portion 26 of the receiver holding part 2 comprises one or a plurality of cushion structures 38, 40, 42, 44, e.g. configured for absorbing mechanical shock.

The damping structure 4 comprises a mounting element 46 at the second sound duct end 15. The mounting element 46 is configured for mounting the suspension 1 to a structural frame of a hearing device and in the illustrated suspension 1 takes the form of a flange.

Figure 2:
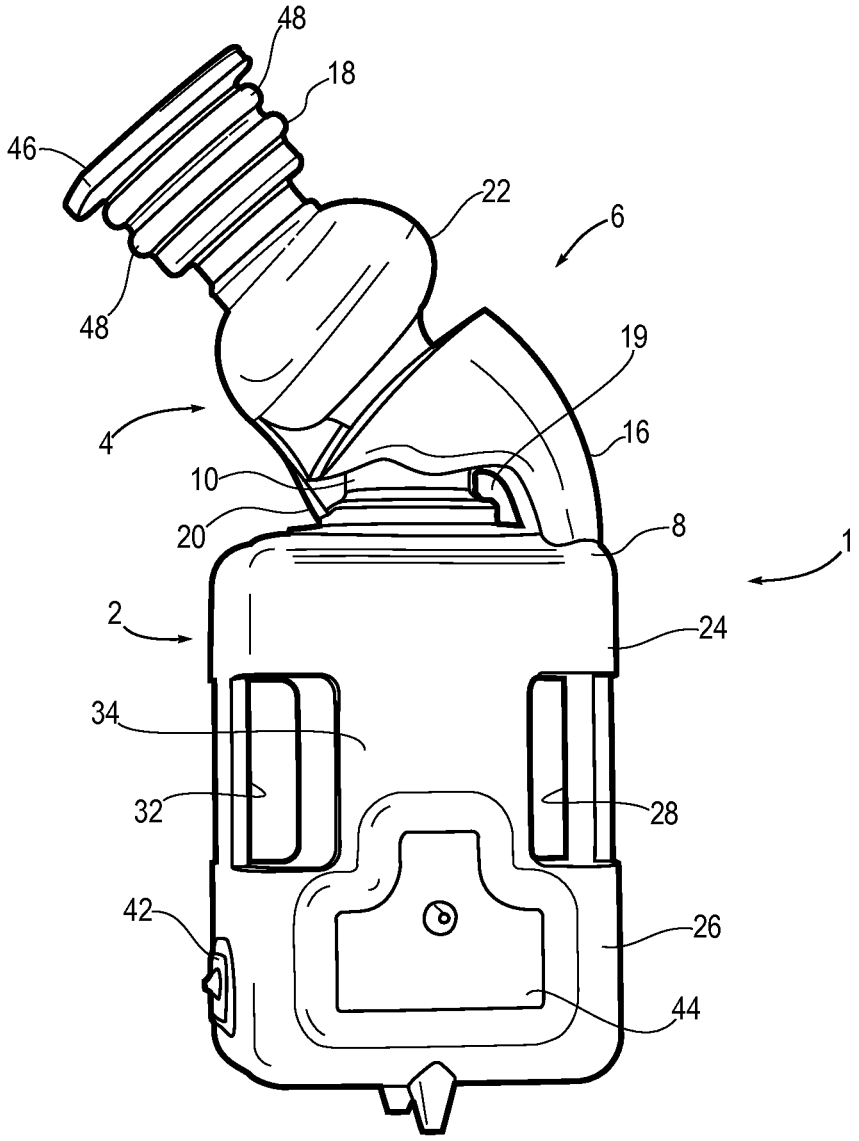
FIG. 2 is a schematic second side view of the suspension in FIG. 1.
Figure 3:
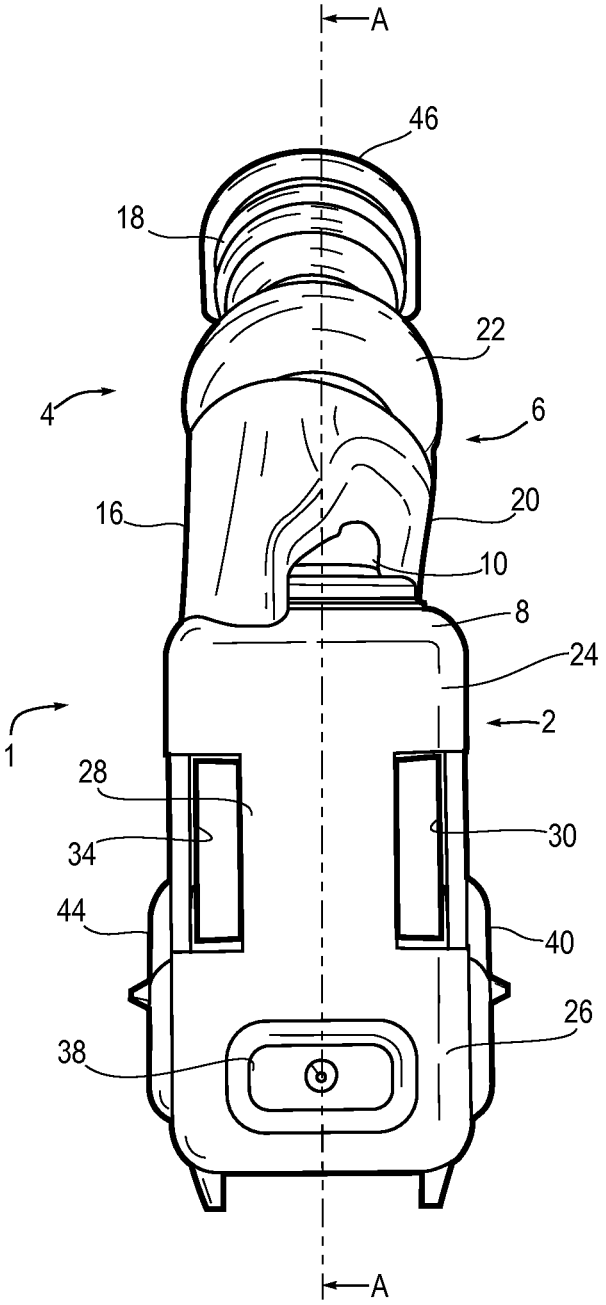
FIG. 3 is a schematic third side view of the suspension in FIG. 1.

FIGS. 2 and 3 are schematic second and third side views of the suspension 1 in FIG. 1. The second body part 18 has one or more annular bulges 48 forming a corrugated second outer surface of the second body part 18 along the sound duct 11.

Figure 4:
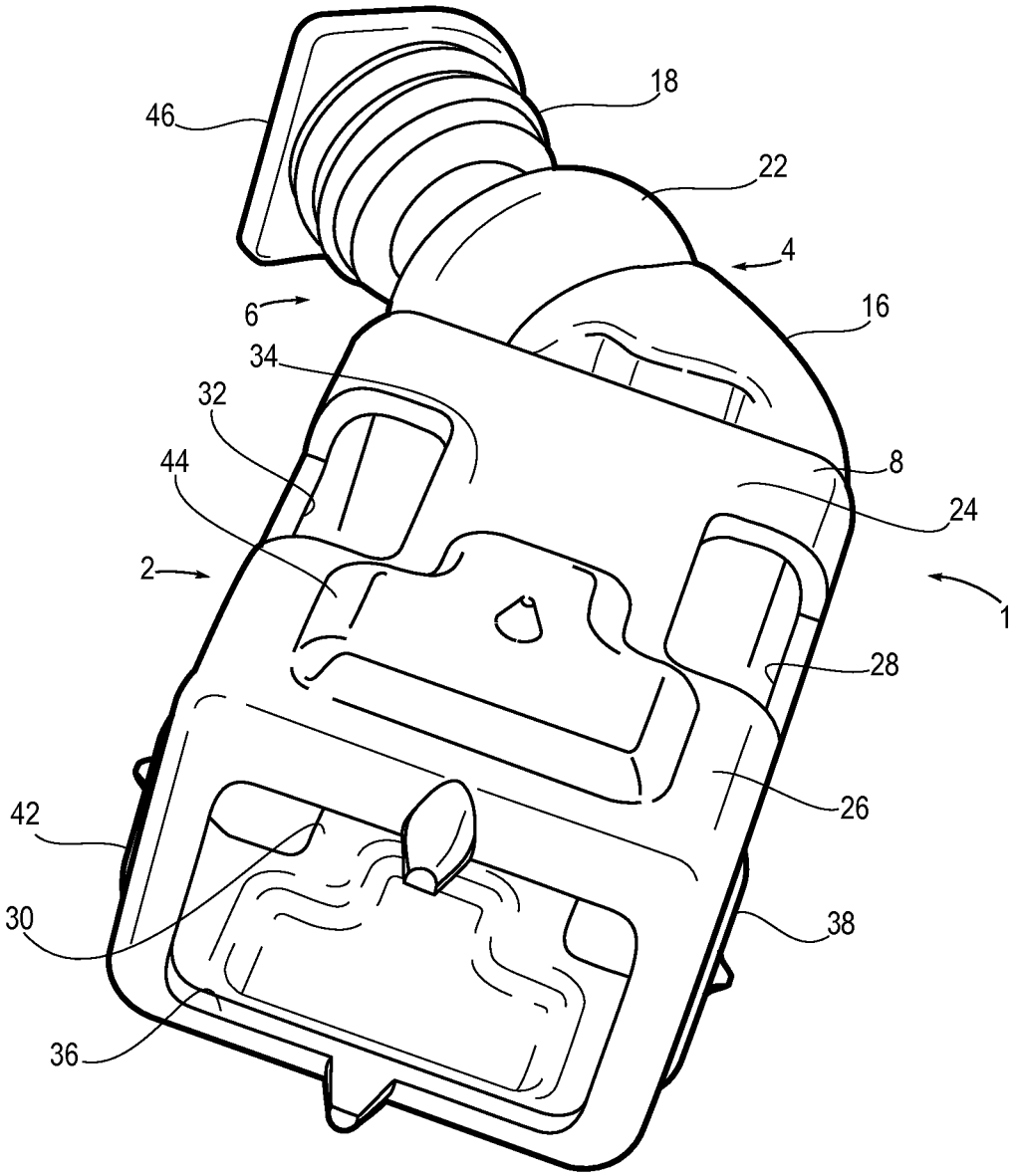
FIG. 4 is a schematic perspective view of the suspension in FIG. 1, FIG. 5 schematically illustrates a side view of an exemplary hearing device structural frame comprising a suspension according to some embodiments, FIG. 6 schematically illustrates an exemplary cut view through the suspension along the line A-A in FIG. 3, FIG. 7 schematically illustrates an end view of the receiver suspension in FIG. 1, FIG. 8 schematically illustrates a first cross section perpendicular to the sound duct along the line B-B in FIG. 1, and FIG. 9 schematically illustrates a first cross section perpendicular to the sound duct of an exemplary suspension.

FIG. 4 is a schematic perspective view of the suspension 1 in FIG. 1. The second portion 26 forms an insertion opening 36 for insertion of a hearing aid receiver in the receiver compartment formed by the receiver holding part 2.

Figure 5:
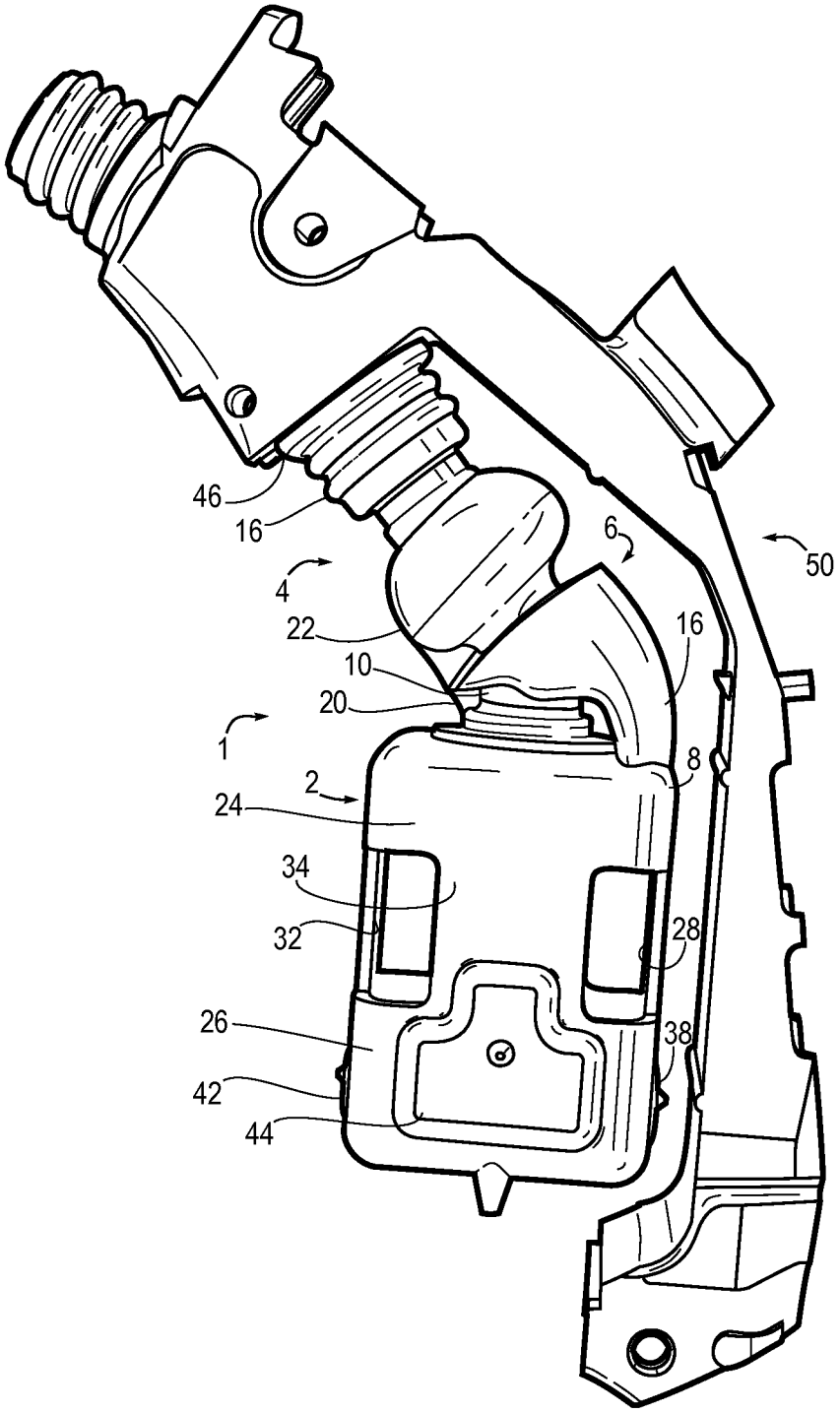

FIG. 5 schematically illustrates a side view of an exemplary hearing device structural frame 50 with a suspension 1 mounted thereon. A behind-the-ear hearing device may then accommodate a hearing device structural frame 50 and a suspension 1, wherein the hearing device receiver is to be mounted in the suspension 1.

Figure 6:
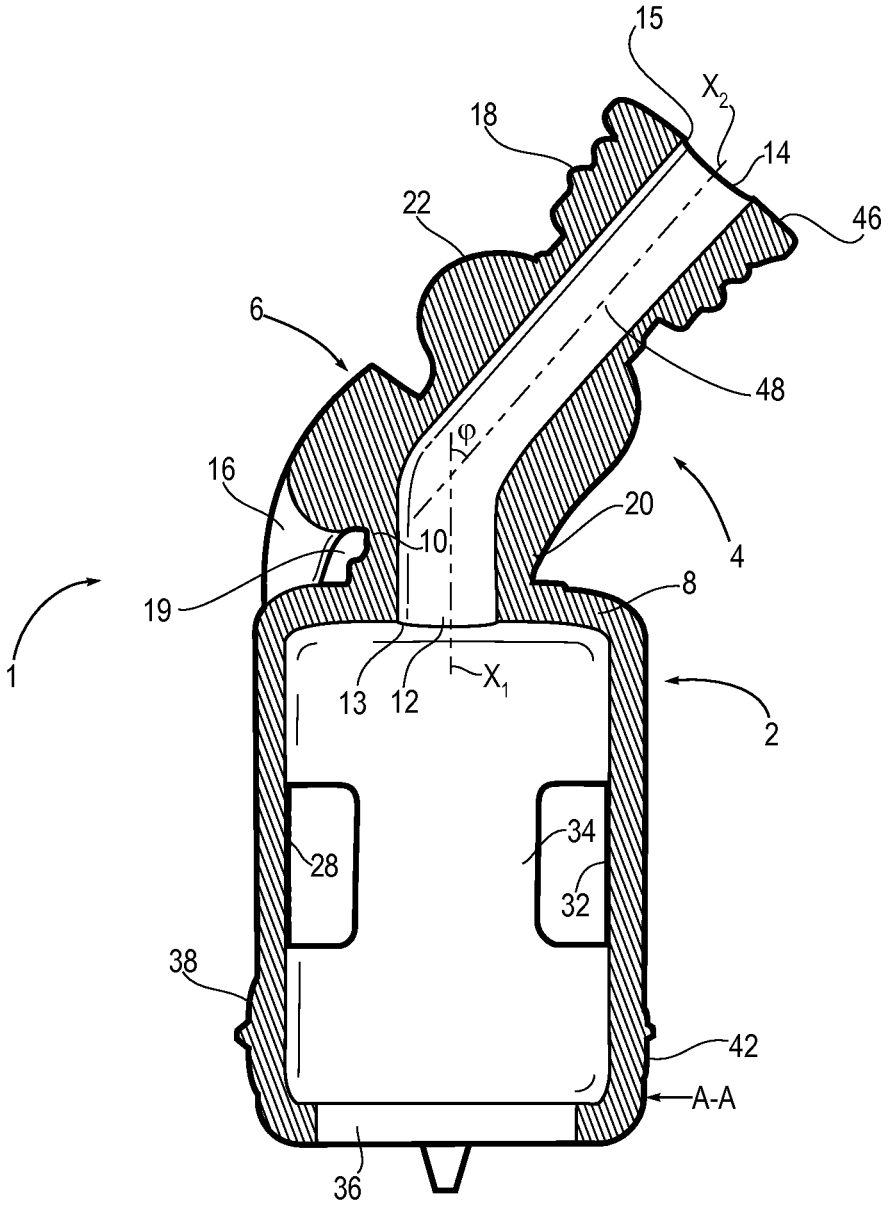

FIG. 6 schematically illustrates an exemplary cut view through the suspension along the line A-A in FIG. 3. A first longitudinal axis $X_1$ of a first sound duct part in the first body part 10, and a second longitudinal axis $X_2$ of a second sound duct part in the second body part 18 forms an angle $\phi$ of 42°. In general, a first longitudinal axis $X_1$ of a first sound duct part in the first body part, and a second longitudinal axis $X_2$ of a second sound duct part in the second body part may form an angle $\phi$ in the range from 15° to 55°, such as from 35° to 50°, advantageously from 40° to 45°. The sound duct 11 has a substantially constant cross-sectional circular shape and constant cross sectional area from the first sound duct end 13 to the second sound duct end 15.

Figure 7:
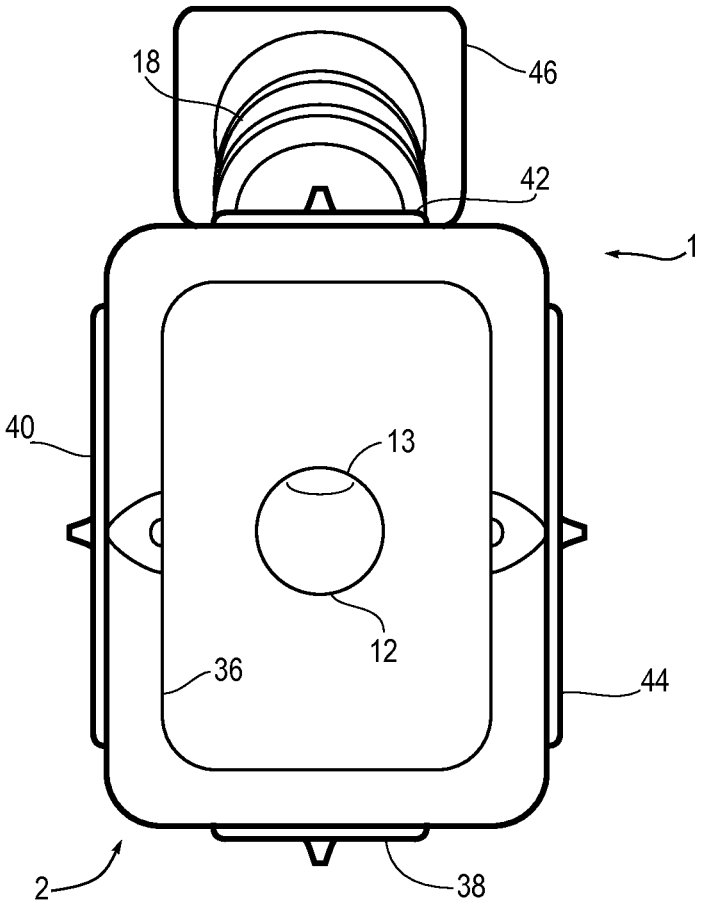

FIG. 7 schematically illustrates an end view of the receiver suspension 1 in FIG. 1. A receiver (not shown) may be mounted in the receiver compartment formed by the receiver holding part 2 through the insertion opening 36 such that an output port of the receiver is fitted into the first opening 12 for feeding sound from the receiver into the sound duct 11.

Figure 8:
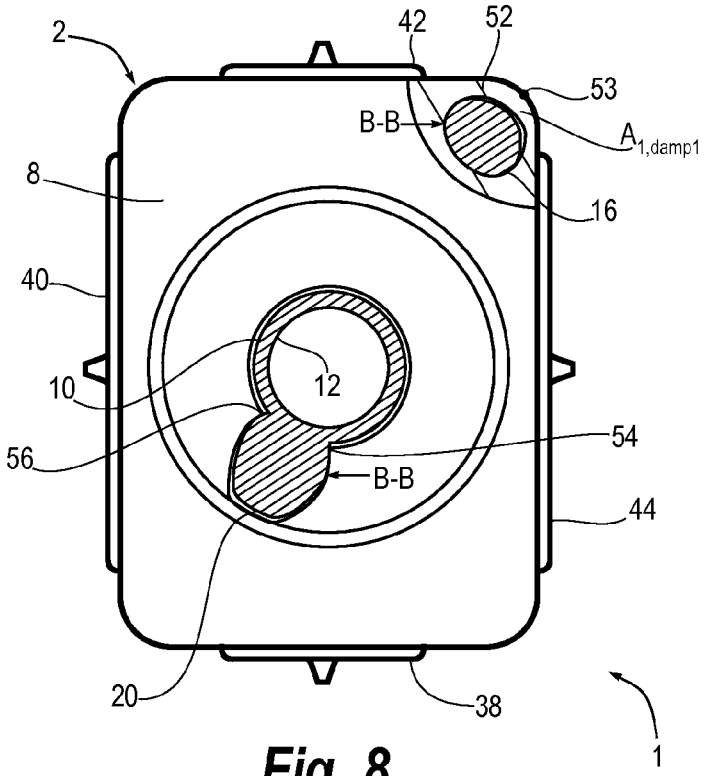

FIG. 8 schematically illustrates a first cross section perpendicular to the sound duct along the line B-B in FIG. 1. The first damping element 16 covers an area $A_{1,damp1}$ in the first cross-section of less than 10% of a receiver base area $A_{base}$ being the maximum area spanned by the receiver base 8 perpendicular to the first longitudinal axis $X_1$. The receiver base area $A_{base}$ may be in the range from 20 $mm^2$ to 200 $mm^2$. The first body part 10 and the second damping element 20 are integrated, and the first outer surface of the first body part 10 has a non-circular shape in the first cross section. The first damping element 16 extends from a corner section 52 of the receiver base 8 within a corner distance of 3 mm from a receiver base corner 53. The first outer surface of the first body part 10 comprises a first concave section 54 and optionally a second concave section 56.

Figure 9:
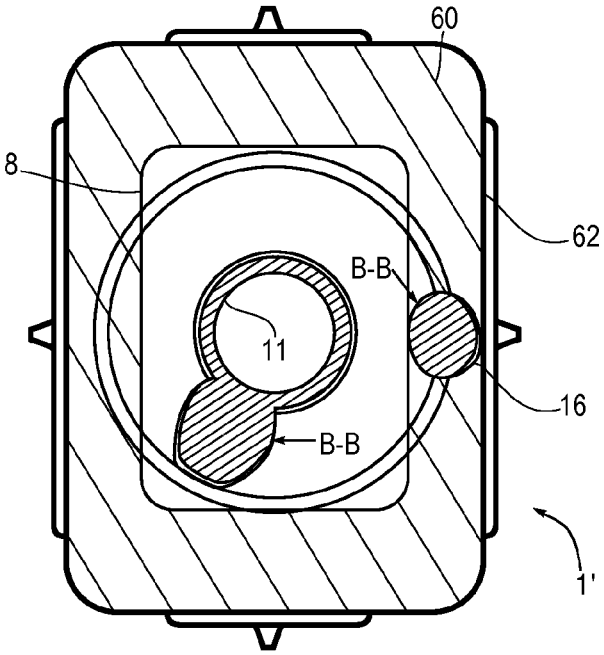

FIG. 9 schematically illustrates a first cross section perpendicular to the sound duct of an exemplary suspension 1'. The first damping element 16 extends from an edge section 60 of the receiver base within an edge distance of 3 mm from the receiver base edge 62.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

LIST OF REFERENCES

1, 1' suspension
2 receiver holding part
4 damping structure
6 body of damping structure
8 receiver base
10 first body part
11 sound duct
12 first opening of sound duct
13 first sound duct end
14 second opening of sound duct
15 second sound duct end
16 first damping element
18 second body part
19 gap
20 second damping element
22 third body part
24 first portion of receiver holding part
26 second portion of receiver holding part
28 first bridge element of receiver holding part
30 second bridge element of receiver holding part
32 third bridge element of receiver holding part
34 fourth bridge element of receiver holding part
36 insertion opening for receiver unit
38 first shock-absorbing cushion structure of receiver chamber
40 second shock-absorbing cushion structure of receiver chamber
42 third shock-absorbing cushion structure of receiver chamber
44 fourth shock-absorbing cushion structure of receiver chamber
46 mounting element
48 annular bulge
50 hearing instrument structural frame
52 corner section of receiver base
53 receiver base corner
54 first concave section
56 second concave section
60 edge section of receiver base
62 receiver base edge
$A_{1,damp1}$, area of first damping element in first cross-section
$A_{base}$ receiver base area

The invention claimed is:

1. A suspension for a receiver in a hearing device, comprising:

a receiver holding part; and a damping structure with a body and a receiver base, the body comprising a first body part, the damping structure having an inner surface forming a sound duct in the damping structure, the sound duct extending through the first body part, the damping structure having a first opening at a first sound duct end, the first opening configured for connecting an output port of a receiver to the sound duct, the damping structure having a second opening at a second sound duct end, the sound duct providing a sound path for conveying sound energy from the receiver through the damping structure to the second opening, the first body part having a longitudinal axis and extending from the receiver base;

wherein the damping structure comprises at least a first damping element connecting the body and the receiver base, the first damping element having an intermediary segment that is separate from the longitudinal axis of the first body part.

2. The suspension according to claim 1, wherein the body comprises a second body part positioned between the second sound duct end and the first body part, the sound duct extending through the second body part, the second body part having a corrugated outer surface.

3. The suspension according to claim 1, wherein the first damping element extends from the receiver base to the body forming a gap between the first damping element and the first body part.

4. The suspension according to claim 1, wherein the first body part comprises a second damping element extending from the receiver base.

5. The suspension according to claim 2, wherein a first longitudinal axis of a first sound duct part in the first body part, and a second longitudinal axis of a second sound duct part in the second body part form an angle that is anywhere from 15° to 45°.

6. The suspension according to claim 5, wherein the first damping element, in a first cross section that is perpendicular to the first longitudinal axis, covers an area of less than 10% of a receiver base area.

7. The suspension according to claim 2, wherein the body comprises a third body part between the first body part and the second body part for absorbing a part of vibrational energy from the receiver.

8. The suspension according to claim 1, wherein a first outer surface of the first body part in a cross section perpendicular to the sound duct is non-circular.

9. The suspension according to claim 1, wherein the receiver holding part forms a receiver compartment and comprises a first portion connected to the receiver base, and a second portion, wherein the first portion and the second portion are connected by a plurality of bridging elements.

10. The suspension according to claim 9, wherein the second portion comprises an insertion opening for insertion of a hearing aid receiver in the receiver compartment.

11. The suspension according to claim 9, wherein the second portion of the receiver holding part comprises a plurality of cushioning zones for absorbtion of mechanical shock.

12. The suspension according to claim 1, wherein the damping structure comprises a mounting element at the second opening for mounting the suspension to a structural frame of the hearing device.

13. A hearing device comprising:

a receiver;

a hearing device structural frame; and a suspension, wherein the receiver is mounted in the suspension;

wherein the suspension comprises:

a receiver holding part; and a damping structure with a body and a receiver base, the body comprising a first body part, the damping structure having an inner surface forming a sound duct in the damping structure, the sound duct extending through the first body part, the damping structure having a first opening at a first sound duct end, the first opening configured for connecting an output port of the receiver to the sound duct, the damping structure having a second opening at a second sound duct end, the sound duct providing a sound path for conveying sound energy from the receiver through the damping structure to the second opening, the first body part having a longitudinal axis and extending from the receiver base;

wherein the damping structure comprises at least a first damping element connecting the body and the receiver base, the first damping element having an intermediary segment that is separate from the longitudinal axis of the first body part.

14. The hearing device according to claim 13, wherein the output port of the receiver is positioned in the first opening of the sound duct.

15. The suspension according to claim 1, wherein the intermediary segment of the first damping element and the first body part form a side-by-side configuration and are both connected to the receiver base.

16. The hearing device according to claim 13, wherein the intermediary segment of the first damping element and the first body part form a side-by-side configuration and are both connected to the receiver base.

* * * * *